United States Patent [19]

Segretto et al.

[11] 4,300,017

[45] Nov. 10, 1981

[54] SHIELDED RIBBON CABLE

[75] Inventors: Bernard A. Segretto, San Jose; Roman J. Burkacki, Los Altos, both of Calif.

[73] Assignee: Sperry Rand Corporation, New York, N.Y.

[21] Appl. No.: 47,387

[22] Filed: Jun. 11, 1979

[51] Int. Cl.[3] ..... H01B 11/10

[52] U.S. Cl. ..... 174/36; 174/117 F; 174/117 FF

[58] Field of Search ..... 174/36, 117 F, 117 FF

[56] References Cited

U.S. PATENT DOCUMENTS

| | | | |
|---|---|---|---|
| 3,173,991 | 3/1965 | Breakfield | 174/117 FF |
| 3,547,718 | 12/1970 | Gordon | 174/117 FF X |
| 3,612,744 | 10/1971 | Thomas | 174/36 |
| 3,728,661 | 4/1973 | Kassabgi | 174/117 F X |
| 3,757,029 | 9/1973 | Marshall | 174/117 F X |

FOREIGN PATENT DOCUMENTS

| | | | |
|---|---|---|---|
| 1086823 | 10/1967 | United Kingdom | 174/117 F |

*Primary Examiner*—Richard R. Kucia

*Attorney, Agent, or Firm*—Thomas H. Olson; Eugene T. Battjer; William E. Cleaver

[57] ABSTRACT

An improved shielded ribbon cable arranged to expedite termination of the shield for grounding the shield. There is an isolator strip placed during fabrication of the cable between the conductor array and the shield; the isolator strip prevents flow of plasticized insulating material between the cover sheet and the conductor array, which usually occurs through the interstices in the shield, so that the shield can be readily separated from the conductor array to permit termination of the shield without jeopardizing the integrity of the insulation on the conductor array.

6 Claims, 5 Drawing Figures

SHIELDED RIBBON CABLE

BACKGROUND OF THE INVENTION

1. Field of the Invention

This invention relates to shielded ribbon cables such as are widely employed for interconnecting computer and like electronic circuit elements, and more particularly to a cable in which termination and connection of the shield can be effected rapidly and easily.

2. Description of the Prior Art

Shielded ribbon cable is widely used, particularly in environments where radio frequency interference and the like is present. In order to achieve good shielding of the conductors from such interference, it is imperative that the shield be connected to the ground at one or more points along the cable run. Connection of the shield to the ground necessitates access to the shield without impairing the conductors or the insulation thereon. Such access is difficult in presently known shielded ribbon cables because the shield is typically of woven or foraminous construction and during fabrication of the cable, portions of the plastic insulative cover are extruded through the foramina of the shield. Such renders removal of insulation from the shield a long and tedious job and requires great care in order to avoid severing the fine gauge conductors of which the shield is formed.

SUMMARY OF THE INVENTION

A shielded cable according to the present invention includes four layers, three of which are conventional; namely, at least one row of insulated conductors bonded together in a substantially flat array, a foraminous conductive flat shield substantially coextensive with the array and an insulative cover sheet for insulating the shield and retaining it in juxtaposition to the array. According to the present invention there is an isolator strip interposed between the conductor array and the shield, at least at the central portion thereof, which isolator strip is formed of a material to which the cover sheet and conductor insulation will not adhere or cohere. Consequently, one wishing to terminate the shield can very easily obtain access thereto without jeopardizing the conductors or the insulation thereon.

The isolator strip is formed of a material having characteristics different from the material of which the conductor insulation and the cover sheet is formed. For example, many shield ribbon cables are fabricated by transporting the array, the shield and the cover sheet to a bonding station at which at least the confronting surfaces of the array and the cover sheet are plasticized, by heat or radiant energy, after which they are bonded together by compression. In adapting the invention to such fabrication procedure the isolator strip is formed of a material that will not be plasticized or otherwise affected by the energy levels employed to plasticize the conductor insulation and the cover sheet.

An object of the invention is to provide a shielded ribbon cable which permits rapid and secure electrical connection into the shield. This object is achieved because the presence of the above mentioned isolator strip permits manipulation and cutting of the cover sheet and the shield without jeopardizing the conductors or the insulation surrounding the conductors.

The foregoing together with other objects, features and advantages will be more apparent after referring to the following specification and the accompanying drawings.

DETAILED DESCRIPTION OF THE PREFERRED EMBODIMENTS

Figure 1:
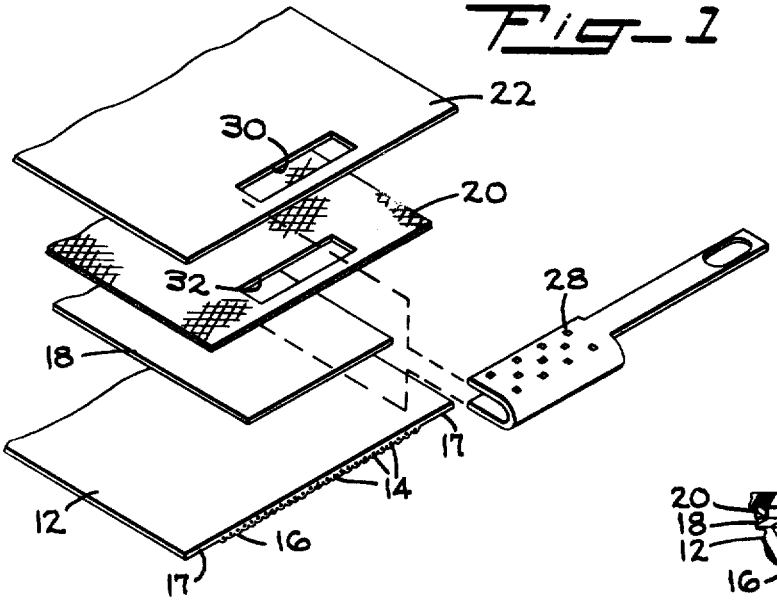
FIG. 1 is a fragmentary exploded view of a shielded ribbon cable embodying the invention.
Figure 2:
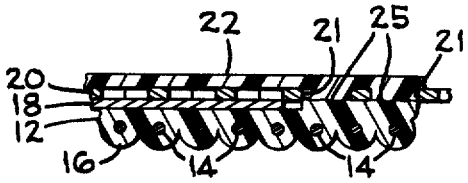
FIG. 2 is a fragmentary view at enlarged scale of a section of the cable of FIG. 1 taken transversely of the cable.

Referring more particularly to the drawing, reference numeral 12 indicates a ribbon cable having a plurality of conductors 14 encased by insulative material 16 to form a flat array of conductors that are insulated from one another and from the exterior. The array has side margins 17 formed of the same material as insulative material 16. Such ribbon cable is a staple article of commerce and is constructed so that conductors 14 are typically of copper, insulative material 16 is typically of polyvinyl chloride (PVC) and is formed so that conductors 14 are uniformly spaced from one another throughout the length of the cable.

An isolator strip 18 has a length coextensive with ribbon cable 12 and a width somewhat less than the width of the ribbon cable. The material of which isolator strip 18 is formed is chosen so that the material is non-adhesive and non-cohesive with respect to insulative material 16 that constitutes a part of ribbon cable 12. In typical practice isolator strip 18 is formed of Mylar or the like and is positioned midway between the lateral extremities of the ribbon cable.

There is a layer 20 formed of conductive shielding material which is foraminous. Typically employed for shield 20 is a layer of flexible material woven from fine copper conductors. Woven material is employed because it is flexible, light in weight and because it defines interstices or foramina 21 between which insulative material 16 can be extruded.

Finally there is a cover sheet 22 which is typically formed of the same material as insulation 16. The cover sheet functions to protect and insulate shield 20 and to retain the shield into intimate juxtaposition to ribbon cable 12 so as to assure good shielding against radio frequency interference and like noise. Cover sheet 22 is typically substantially coextensive both in length and width with ribbon cable 12.

Figure 5:
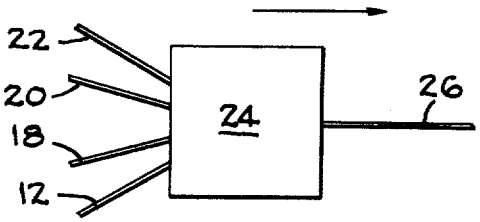
FIG. 5 is a schematic showing a satisfactory manufacturing method of a cable according to the invention.

Before an explanation of the salutary advantages arising from the use of the shielded cable embodying the present invention, a description of the manner of fabricating the flat shielded cable will be described in reference to FIG. 5. There is a bonding station 24 having an inlet at the lefthand side thereof as viewed in the drawing. Transported to the inlet end are insulated conductor array 12, isolator strip 18, conductive foraminous shield 20 and cover sheet 22. At bonding station 24 at least the confronting surfaces of conductor array 12 and cover sheet 22 are treated so as to bond to one another when compressed. The treatment of the confronting surfaces can be accomplished by subjecting the confronting surfaces to heat energy or by radiating the surfaces with microwave energy of a suitable wavelength to plasticize the material of which insulation 16 and cover sheet 22 are formed. Alternatively an adhesive or solvent can be applied to the confronting surfaces to plasticize them. When such confronting surfaces have been plasticized, compressive forces are applied to the four layers within bonding station 24 so that the plasticized material on the confronting surfaces of conductor array 12 and cover sheet 22 will adhere or cohere to one another. At the margins, i.e., exterior of the lateral edges of isolator strip 18, the plasticized material is extruded or forced through the foramina in foraminous shield 20 to form bonds 25 which retain the layers in a unitary assembly in which conductive shield 20 is in intimate juxtaposition to conductor array 12. Such unitary assembly constitutes the improved shielded ribbon cable 26 of the invention which upon solidification of the plasticized confronting surfaces is coiled or otherwise prepared for entry into commerce.

Because isolator strip 18 neither coheres or adheres to conductor array 12 nor to the portion of cover sheet 22 that may be extruded through the foramina of shield 20 during fabrication of the shielded cable, installation of a conventional crimp terminal 28 can be achieved very quickly. If connection to the shield at a site spaced from the ends of the shielded ribbon cable is desired, an opening 30 in cover sheet 22 and an opening 32 in shield 20 can be formed with a sharp knife or like instrument. In cutting openings 30 and 32 the presence of isolator strip 18 facilitates formation of the openings without cutting or otherwise injuring insulation 16 in conductor array 12. Moreover, when the openings are formed, the crimp terminal can easily be slid beneath shield 20 because there is no significant cohesion or adhesion between shield 20 and the isolator strip.

Figure 3:
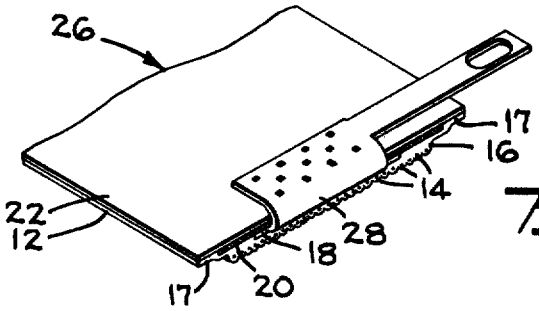
FIG. 3 is a perspective showing termination of the shield adjacent the end of the cable.

Installation of crimp terminal 28 at the end of the cable is likewise facilitated on a cable constructed according to the invention. Having reference to FIG. 3, a space between the upper surface of isolator strip 18 and the lower surface of shield 20 can be formed by separating those layers at the end of the shielded ribbon cable. The crimp terminal can be slipped in so as to embrace shield 20 and cover sheet 22 and can be crimped to effect mechanical and electrical connection to the shield.

Figure 4:
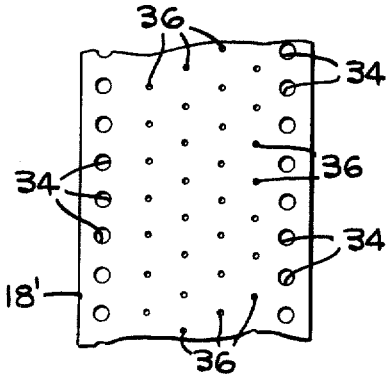
FIG. 4 is a fragmentary view of an alternate form of isolator strip.

In FIG. 4 there is a modified form of isolator strip generally indicated at 18'. The width of the strip is approximately that of conductor array 12 and cover sheet 22. Adjacent the lateral margins of isolator strip 18' are relatively large perforations 34 which permit bonding between the plasticized confronting surfaces of conductor array 12 and cover sheet 22 during formation of the cable in bonding station 24. The inner or central regions of isolator strip 18' can be formed with minute perforations 36 which are sized in reference to the strength of the material of which insulation 16 and cover sheet 22 are constructed so as to permit very thin, relatively weak bonds through the perforations and the foramina in shield 20. Because such bonds are of extremely small cross-sectional area as compared with the bonds present through relatively large perforations 34, the bonds are readily frangible so that shield 20 can be easily separated from isolator strip 18' to afford installation of crimp terminal 28.

For the purpose of affording a clearer understanding of the invention and not for the purpose of limiting the invention, a specific exemplary shielded cable formed according to the invention will be described. Conductor array 12 in such exemplary shielded ribbon cable has fifty conductors 14 spaced on 0.050 inch centers, an overall width of approximately 2.75 inches and insulation 16 which is formed of PVC. Isolator strip 18 is formed of such material as Teflon, Mylar or Kapton. The width of the strip is approximately one inch and the strip is positioned midway between the lateral edges of the cable. Shield 20 has a width slightly less than the width of conductor array 12 and cover sheet 22 has a width substantially equal to that of the conductor array. The cover sheet is formed of the same material as insulation 16; namely, PVC. In manufacturing such shielded ribbon cable the four layers are transported to bonding station 24 as described above in connection with FIG. 5. Within the bonding station the temperature of the confronting surfaces of conductor array 12 and cover sheet 22 are raised to a temperature in the range of about 310° F.–348° F. at which temperature the PVC becomes plasticized; i.e., becomes partially melted and sticky. The temperature required to plasticize the material of which isolator strip 18 is formed is substantially higher, for example, 700° F. in the case of Mylar. Accordingly, at the temperature established within bonding station 24 to plasticize the confronting surfaces of conductor array 12 and cover sheet 22, the isolator strip is virtually unaffected. When the confronting surfaces have been plasticized, the four layers are conducted through compression rolls (not shown) or the like so that bonding of the layers is accomplished. Except at the edges of the cable, the plasticized material is extruded through the foramina of shield 20 to effect the bond. Of course the presence of isolator strip 18 prevents any such bonding throughout an area coextensive with the isolator strip.

In the case of manufacture of a shielded ribbon cable employing the modified isolator strip 18' shown in FIG. 4, the presence of relatively large perforations 34 permits firm bonding at the edges of the shielded ribbon cable but the presence of relatively minute perforations 36 at the center portion of the modified isolator strip permits a minor degree of bonding which is readily frangible and can be easily broken for insertion of a crimp terminal such as crimp terminal 28 shown in the drawing.

Thus it will be seen that the present invention provides a shielded ribbon cable in which the shield can be electrically terminated with great speed and facility and without jeopardizing the integrity of the conductors or the insulation surrounding the conductors. The improved shielded ribbon cable can be fabricated by existing manufacturing processes and equipment without significant modification thereof. Although several embodiments of the invention have been shown and described it will be obvious that other adaptations and modifications can be made without departing from the true spirit and scope of the invention.

What is claimed is:

1. In a shielded ribbon cable of the type having at least one row of insulated conductors bonded together in a substantially flat array, a flexible foraminous conductive flat shield lying along the flat array and having a width corresponding to that of the array to shield the same from radio frequency interference and the like, and an insulative cover sheet overlying said shield and bonded to said array for retaining said shield in juxtaposition to said array, said cover sheet being laterally coextensive with said array, the improvement consisting essentially of a flat electrically insulative isolator strip intermediate said shield and said array and longitudinally coextensive therewith for preventing bonding of the central region of said cover sheet to said array through the foramina of said shield, said isolator strip being formed of material that is substantially nonadhesive and noncohesive to said insulation and having lateral edges less extensive than said array and said cover sheet to afford bonding between said array and cover sheet at the lateral margins thereof.

2. A ribbon cable according to claim 1 wherein said insulation and said cover sheet are formed of material that is plasticized when subjected to a given energy level and wherein said isolator strip is substantially unaffected at said given energy level.

3. A ribbon cable according to claim 2 wherein said insulation and said cover sheet are formed of polyvinyl chloride.

4. An improved ribbon cable according to claim 1 wherein said isolator strip has opposite lateral margins formed with relatively large perforations to afford bonding between said array and said cover sheet through said perforations and foramina of said foraminous shield.

5. An improved ribbon cable according to claim 4 wherein said isolator strip is formed with minute perforations between said lateral margins, said minute perforations being sized to admit therethrough a bond between said flat array and said cover sheet of such small size as to be readily frangible.

6. An improved ribbon cable according to claim 1 wherein the width of said isolator strip is less than the width of said array and said cover sheet, said lateral edges being disposed parallel to and inward of the lateral edges of said array and said cover sheet so that said array and said cover sheet are bonded to one another at margins extending between the edge of said isolator strip and the edges of said array and said cover sheet.

* * * * *